US007403595B2

(12) United States Patent
Kim et al.

(10) Patent No.: US 7,403,595 B2
(45) Date of Patent: Jul. 22, 2008

(54) X-RAY TUBE SYSTEM WITH DISASSEMBLED CARBON NANOTUBE SUBSTRATE FOR GENERATING MICRO FOCUSING LEVEL ELECTRON-BEAM

(75) Inventors: Jong Uk Kim, Seoul (KR); Hae Young Choi, Seoul (KR)

(73) Assignee: Korean Electro Technology Research Institute, Changwon-si, Kyungsangnam-do (KR)

( * ) Notice: Subject to any disclaimer, the term of this patent is extended or adjusted under 35 U.S.C. 154(b) by 0 days.

(21) Appl. No.: 11/783,046

(22) Filed: Apr. 5, 2007

(65) Prior Publication Data

US 2007/0237300 A1 Oct. 11, 2007

(30) Foreign Application Priority Data

Apr. 5, 2006 (KR) ..... 10-2006-0030787

(51) Int. Cl.
*H01J 35/00* (2006.01)
*H01J 35/06* (2006.01)
*H01J 35/14* (2006.01)

(52) U.S. Cl. ..... 378/122; 378/136; 378/138

(58) Field of Classification Search ..... 378/119, 378/121–123, 136–138
See application file for complete search history.

(56) References Cited

U.S. PATENT DOCUMENTS 7,085,351 B2 * 8/2006 Lu et al. ..... 378/122
2003/0002627 A1 * 1/2003 Espinosa et al. ..... 378/136
2003/0142790 A1 * 7/2003 Zhou et al. ..... 378/119
2005/0281379 A1 * 12/2005 Qiu et al. ..... 378/122

* cited by examiner

*Primary Examiner*—Irakli Kiknadze
(74) *Attorney, Agent, or Firm*—Robert E. Bushnell, Esq.

(57) ABSTRACT

Disclosed is an X-ray tube system with a disassembled carbon nanotube substrate for generating micro focusing level electron beams. A housing provides a vacuum space. An anode forms an electric field by a voltage applied from the outside and accelerates the electrons emitted from the cathode to reach the anode itself. A carbon nanotube substrate used as a cathode corresponding to the anode. A cathode plate supports and fixes the carbon nanotube substrate and applies a voltage to the carbon nanotube substrate. A sample probe is installed assemblably/disassemblably in the housing. A grid electrode is installed in front of the carbon nanotube substrate and extracting electrons from the carbon nanotube substrate in an easy manner. An electron focusing lens focuses the electrons passed through the grid electrode to form a micro level focus in the anode. A feed through applies a voltage to the cathode, the grid electrode and the electron focusing lens. A vacuum pump sustains a vacuum state inside the housing in exchanging the carbon nanotube substrate. A vacuum valve isolates the inside from the outside of the housing when the sample probe is inserted into the housing and disassembled from the housing.

4 Claims, 6 Drawing Sheets

X-RAY TUBE SYSTEM WITH DISASSEMBLED CARBON NANOTUBE SUBSTRATE FOR GENERATING MICRO FOCUSING LEVEL ELECTRON-BEAM

CLAIM OF PRIORITY

This application makes reference to, incorporates the same herein, and claims all benefits accruing under 35 U.S.C. §119 from an application for X-RAY TUBE SYSTEM WITH DISASSEMBLED CARBON NANOTUBE SUBSTRATE FOR GENERATING MICRO FOCUSING LEVEL ELECTRON-BEAM earlier filed in the Korean Intellectual Property Office on 5 Apr. 2006 and there duly assigned Serial No.10-2006-0030787.

BACKGROUND OF THE INVENTION

1. Field of the Invention

The present invention relates to an X-ray tube system with a carbon nanotube substrate, and more particularly to an X-ray tube system with a disassembled carbon nanotube substrate for generating micro focusing level electron beams that employs a quantum-mechanical field emission principle for emitting electrons and uses a carbon nanotube as cathode in an electron emitter and in which users can easily exchange a carbon nanotube cathode under a high vacuum state when the carbon nanotube cathode is broken down.

2. Description of the Prior Art

In the X-ray tube system, conventional tungsten filament cathodes emit an X-ray light source using thermal electrons generated by heating of filaments themselves. However, such an X-ray tube system using the tungsten filament cathode has problems that it is difficult for users to use the system since its manufacturing cost is high due to its enormously large scale and it is used in limited locations. Also, quality in radioactive rays is deteriorated because the thermal electrons generated by heating of the filaments are not emitted in a regular direction, and radioactive rays in a target are generated in a low level due to the low density of the thermal electrons. Also, it may be impossible to use the target since gases, formed in filaments and a focusing unit, may significantly reduce a vacuum degree, which results in internal discharging, and a life span of the target may be shortened due to the generated heat. In addition, if the tungsten filament is used for an extended period, tungsten is evaporated from a surface of the filament, and therefore an external diameter of the filament becomes smaller and an emission characteristic of the thermal electrons may be deteriorated. At this time, the evaporated tungsten is deposited onto an inner wall of a glass bulb, resulting in deterioration of dielectric strength at high voltage and reduction in capacity of transmitted radioactive rays. In order to solve the above problems, a disassembled X-ray tube using a filament cathode has been presented, but it is not a solution to the above various problems since the filament is used as a light source.

Meanwhile, recently studied light source techniques for emitting laser-based radioactive rays and light source techniques using a large synchrotron source are difficult to apply to machinery and semiconductor industries due to the limitations on huge installation cost, spatial volume and mobility, and these light source techniques are recently limitedly used in the certain research fields such as pure sciences since they have numerous commercial limitations. Also, some of the domestic and foreign research institutes have studied the carbon nanotube-based apparatuses for generating X-rays, but even though the X-ray tubes have a sealed structure which is identical to those of the conventional tubes using tungsten filaments, or has an assemblable/disassemblable structure, their assembling/disassembling processes are very complex, and, in particular, a high vacuum may be ruined during the assembling process.

SUMMARY OF THE INVENTION

Accordingly, the present invention is designed to solve such drawbacks of the prior art, and therefore an object of the present invention is to provide an X-ray tube system with a disassembled carbon nanotube substrate for generating micro focusing level electron beams that employs a quantum-mechanical field emission principle for emitting electrons and uses a carbon nanotube as cathode in an electron emitter and in which users can easily exchange a carbon nanotube cathode under a high vacuum state when the carbon nanotube cathode is broken down.

One embodiment of the present invention is achieved by providing an X-ray tube system with a disassembled carbon nanotube substrate for generating micro focusing level electron beams which has an X-ray tube in which electrons emitted from a cathode collide against an anode to emit radioactive rays, the X-ray tube system including:

- a housing for providing a vacuum space so that the electrons emitted from the cathode collide against an anode to emit radioactive rays;
- an anode installed in one side inside the housing and forming an electric field by means of a voltage applied from the outside and accelerating the electrons emitted from the cathode to reach the anode itself;
- a carbon nanotube substrate installed inside the housing as a cathode corresponding to the anode and spaced apart at a certain distance from the anode, and having a surface in which a carbon nanotube that emits electrons by application of voltage grows;
- a cathode plate for supporting and fixing the carbon nanotube substrate and applying a voltage to the carbon nanotube substrate;
- a sample probe installed assemblably/disassemblably in the housing and coupled to the carbon nanotube substrate to form one integrated set so that only a carbon nanotube substrate is exchanged when the carbon nanotube substrate is broken down;
- a grid electrode installed in front of the carbon nanotube substrate and extracting electrons from the carbon nanotube substrate in an easy manner;
- an electron focusing lens installed in front of the grid electrode and focusing the electrons passed through the grid electrode to form a micro level focus in the anode;
- a feed through installed in a plural number around the sample probe and applying a voltage to the cathode, the grid electrode and the electron focusing lens;
- a vacuum pump installed assemblably/disassemblably in one side of the housing and sustaining a vacuum state inside the housing in exchanging the carbon nanotube substrate; and
- a vacuum valve for isolating the inside from the outside of the housing when the sample probe is inserted into the housing and disassembled from the housing.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

Figure 1:
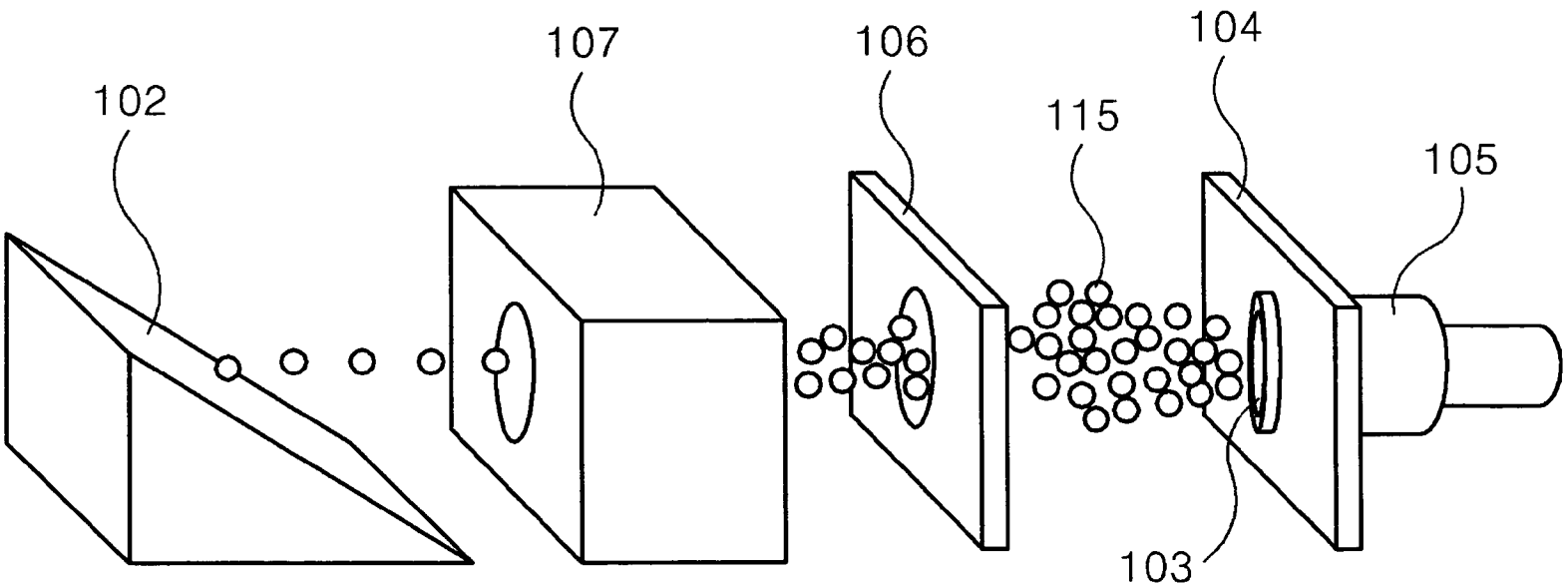
FIG. 1 is a diagram schematically showing an X-ray tube in an X-ray tube system with a disassembled carbon nanotube substrate for generating micro focusing level electron beams according to the present invention.

Hereinafter, preferable embodiments according to the present invention will be described with reference to the accompanying drawings. Here, when one element is connected to another element, one element may be not only directly connected to another element but also indirectly connected to another element via another element. Further, irrelative elements are omitted for clarity. Also, like reference numerals refer to like elements throughout.

Figure 2:
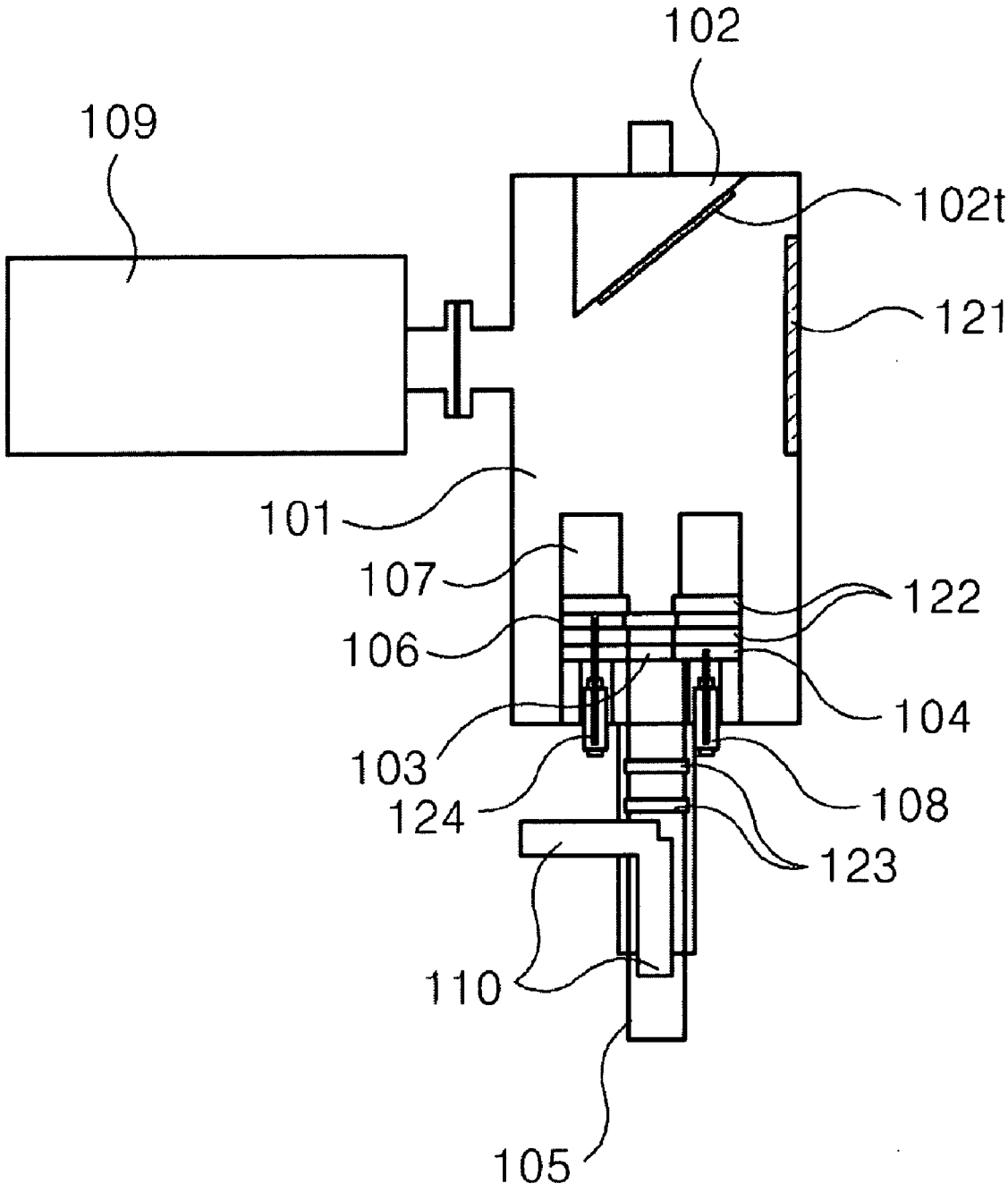
FIG. 2 is a perspective view showing the X-ray tube system with a disassembled carbon nanotube substrate for generating micro focusing level electron beams according to the present invention.

FIG. 1 and FIG. 2 show an X-ray tube system with a disassembled carbon nanotube substrate for generating micro focusing level electron beams according to the present invention. Here, FIG. 1 is a diagram schematically showing an X-ray tube, and FIG. 2 is a perspective view showing an X-ray tube system.

Referring to FIG. 1 and FIG. 2, the X-ray tube system with adisassembled carbon nanotube substrate for generating micro focusing level electron beams according to the present invention includes a housing 101, an anode 102, a carbon nanotube substrate 103, a cathode plate 104, a sample probe 105, a grid electrode 106, an electron focusing lens 107, a feed through 108, a vacuum pump 109 and a vacuum valve 110.

The housing 101 provides a vacuum space in which electrons emitted from the cathode collide against the anode to emit radioactive rays. As materials of such a housing 101, it is possible to use materials, for example Pyrex, glass, ceramics, stainless steel, etc., which may sustain a vacuum state and may be electrically heated to remove off gas (gas generated together with the radioactive rays which are generated when electrons collide against a target 102*t* of the anode) from the inside of the housing, if necessary.

The anode 102 is installed in one side inside the housing 101, and serves to form an electric field by means of a voltage applied from the outside and accelerating the electrons emitted from the cathode to reach the anode itself. As materials of such an anode 102, it is possible to use conductive materials, for example tungsten, etc., which may easily emit radioactive rays.

The carbon nanotube substrate 103 is installed inside the housing 101 as a cathode corresponding to the anode 102 and spaced apart at a certain distance from the anode 102, and has a surface in which a carbon nanotube that emits electrons by application of voltage grows.

The cathode plate 104 serves to support and fix the carbon nanotube substrate 103 and apply a voltage to the carbon nanotube substrate 103. As materials of such a cathode plate 104 it is possible to use conductive materials, for example stainless steel, etc., which may easily apply a voltage.

Figure 3:
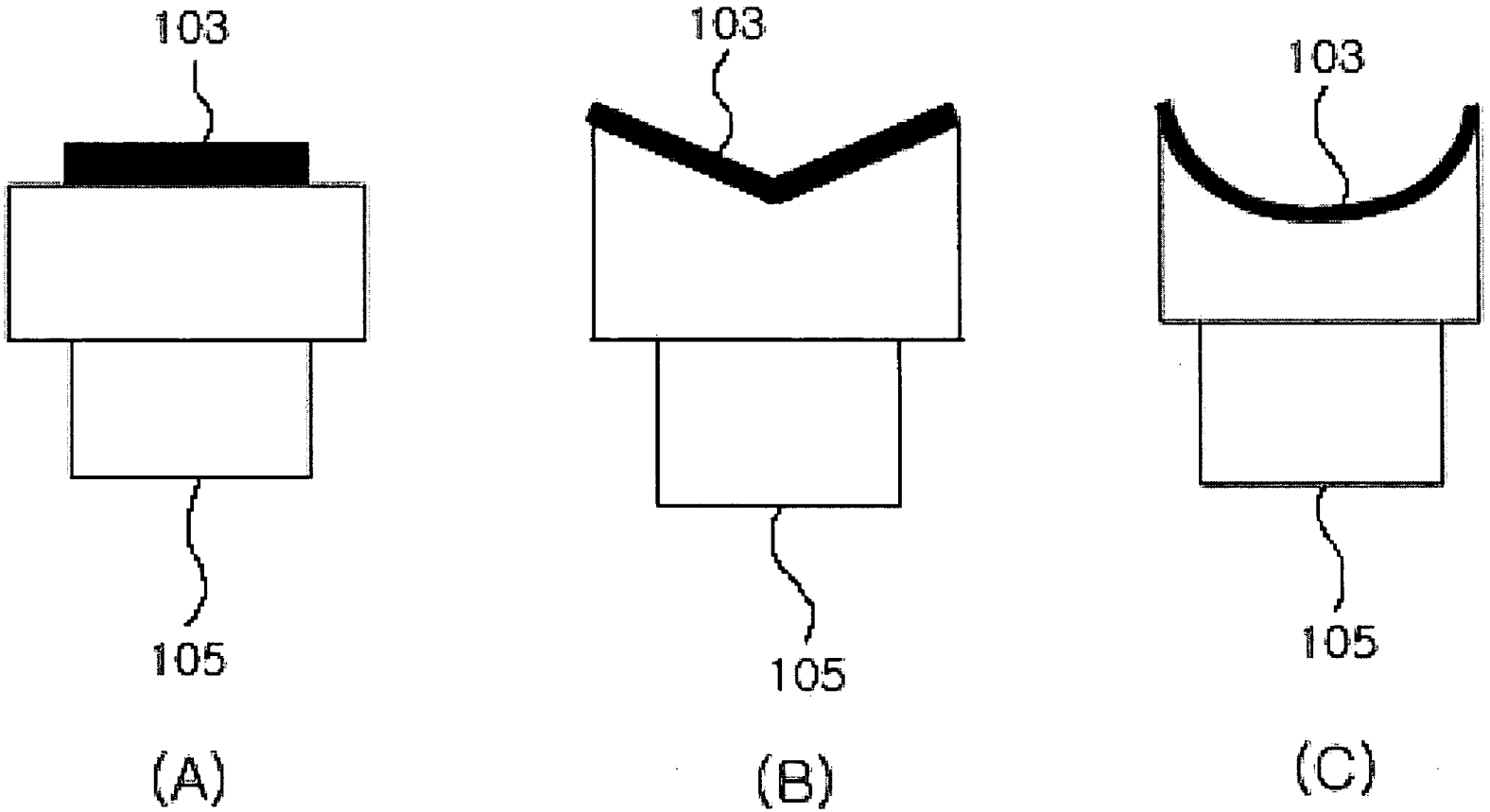
FIG. 3 is a diagram showing various embodiments of a carbon nanotube substrate and a sample probe in the X-ray tube system with a disassembled carbon nanotube substrate for generating micro focusing level electron beams according to the present invention.

The sample probe 105 is installed assemblably/disassemblably in the housing 101 and coupled to the carbon nanotube substrate 103 to form one integrated set so that only a carbon nanotube substrate 103 can be exchanged when the carbon nanotube substrate 103 is broken down. Such a sample probe 105 may be formed with various structures, depending on configuration of the used carbon nanotube substrate 103, as shown in (A) to (C) of FIG. 3.

The grid electrode 106 is installed in front of the carbon nanotube substrate 103 and serves to extract electrons from the carbon nanotube substrate 103 in an easy manner. Such a grid electrode 106 whose network has thin lines and having large holes maybe used to extract electrons in an easy manner. And, as materials of the grid electrode 106, it is possible to use conductive materials, for example tungsten, stainless steel, etc., which may easily apply a voltage.

Figure 4:
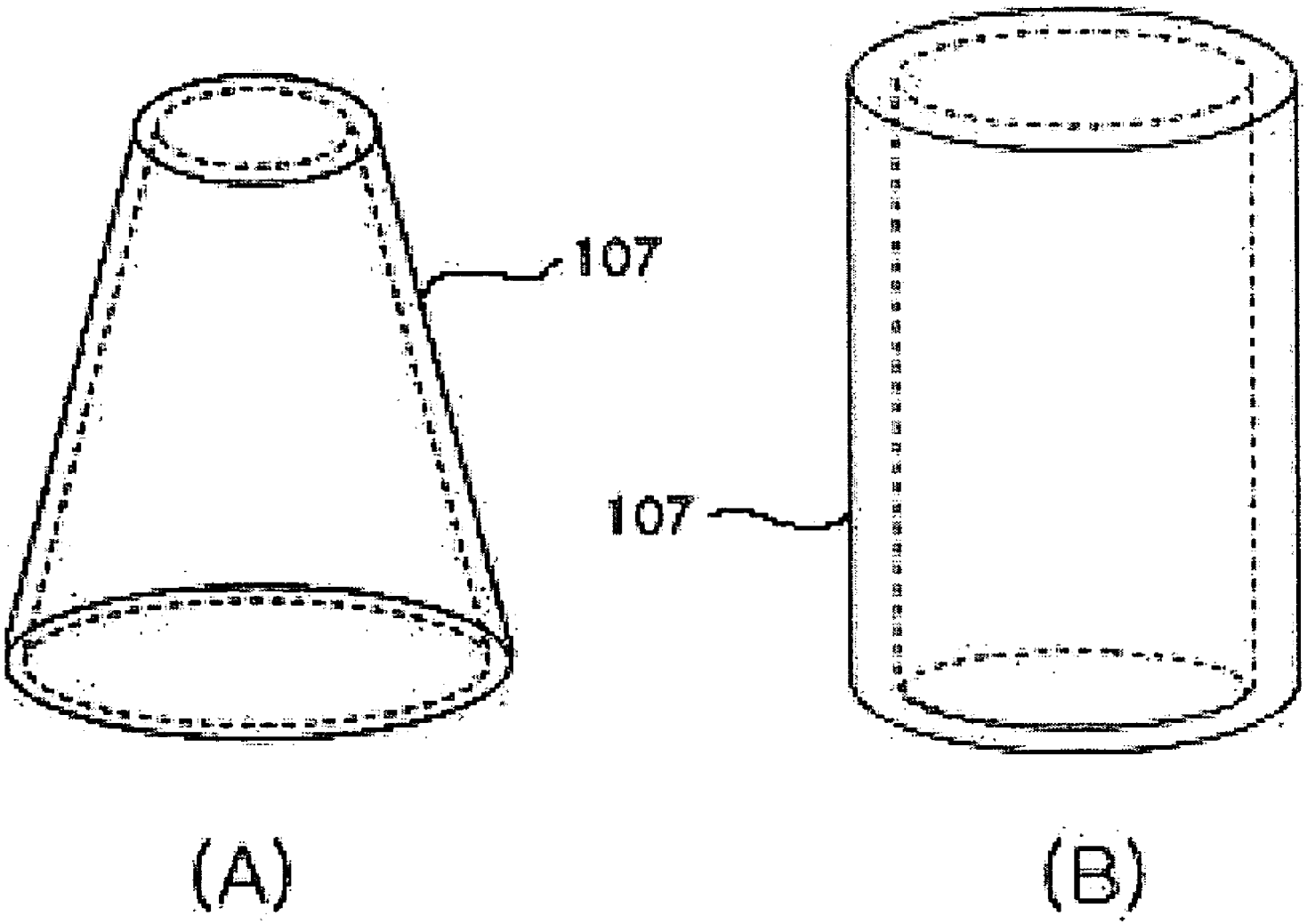
FIG. 4 is a diagram showing embodiments of an electron focusing lens in the X-ray tube system with a disassembled carbon nanotube substrate for generating micro focusing level electron beams according to the present invention.

The electron focusing lens 107 is installed in front of the grid electrode 106 and serves to focus the electrons passed through the grid electrode 106 to form a micro level focus in the anode 102. Such an electron focusing lens 107 may be manufactured with the shape of a tapered-type tube (a frusto-conical cone) as shown in (A) of FIG. 4 or a spherical tube as shown in (B) of FIG. 4. However, the electron focusing lens 107 is manufactured with the shape of a tapered-type tube (a frusto-conical cone) as shown in (A) of FIG. 4 for the purpose of high-density focusing of the electrons.

And, as materials of such an electron focusing lens 107, it is possible to use conductive materials, for example stainless steel, etc., which may easily apply a voltage. Also, the length and inside diameter of the electron focusing lens 107 may be widely varied for the purpose of the optimum high-density focusing of the electrons.

Figure 5:
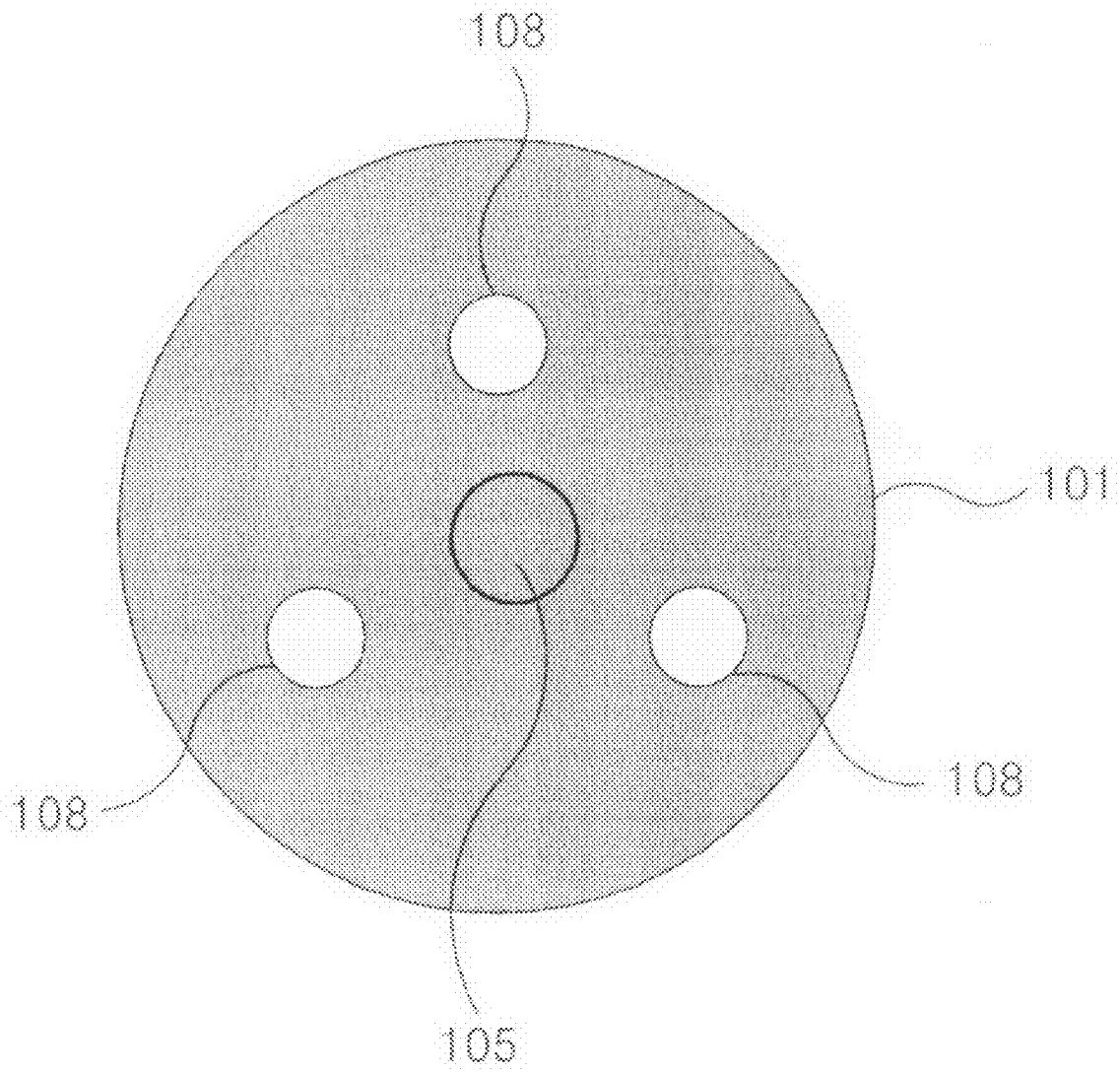
FIG. 5 is a diagram showing how to install a sample probe and feed throughs in the X-ray tube system with a disassembled carbon nanotube substrate for generating micro focusing level electron beams according to the present invention.

As shown in FIG. 5, a plurality of the feed throughs 108 are installed in a plural number around the sample probe 105 and serve to apply a voltage to the cathode (a carbon nanotube substrate) 103, the grid electrode 106 and the electron focusing lens 107.

The vacuum pump 109 is installed assemblably/disassemblably in one side of the housing 101 and serves to sustain a vacuum state inside the housing 101 in exchanging the carbon nanotube substrate 103. Here, it is apparent that such a vacuum pump 109 may not only be used to sustain a vacuum state inside the housing 101 in exchanging the carbon nanotube substrate 103 as described above, but also to increase a vacuum degree of the X-ray tube (a housing) again when the vacuum degree is decreased to a level lower than the set reference value, regardless of exchanging the carbon nanotube substrate 103 as described above.

The vacuum valve 110 serves to isolate the inside from the outside of the housing 101 when the sample probe 105 is inserted into the housing 101 and disassembled from the housing 101.

In FIG. 1 and FIG. 2, a reference numeral 115 represents electrons emitted from the carbon nanotube substrate 103; a reference numeral 121 represents a beryllium window for reducing noise radioactive rays and transmitting desired radioactive rays when emitting radioactive rays; a reference numeral 122 represents a dielectric layer for insulation between the electron focusing lens 107 and the grid electrode 106, and between the grid electrode 106 and the cathode (a carbon nanotube substrate) 103; a reference numeral 123 represents an O-ring for sustaining a vacuum state when the sample probe 105 is coupled to the housing 101 and for assembling and disassembling the sample probe 105 to and from the housing 101, respectively; and a reference numeral 124 represents a cable for electrically connecting the electron focusing lens 107 and the cathode (carbon nanotube substrate) 103 to the grid electrode 106 and the feed through 108, respectively.

Figure 6:
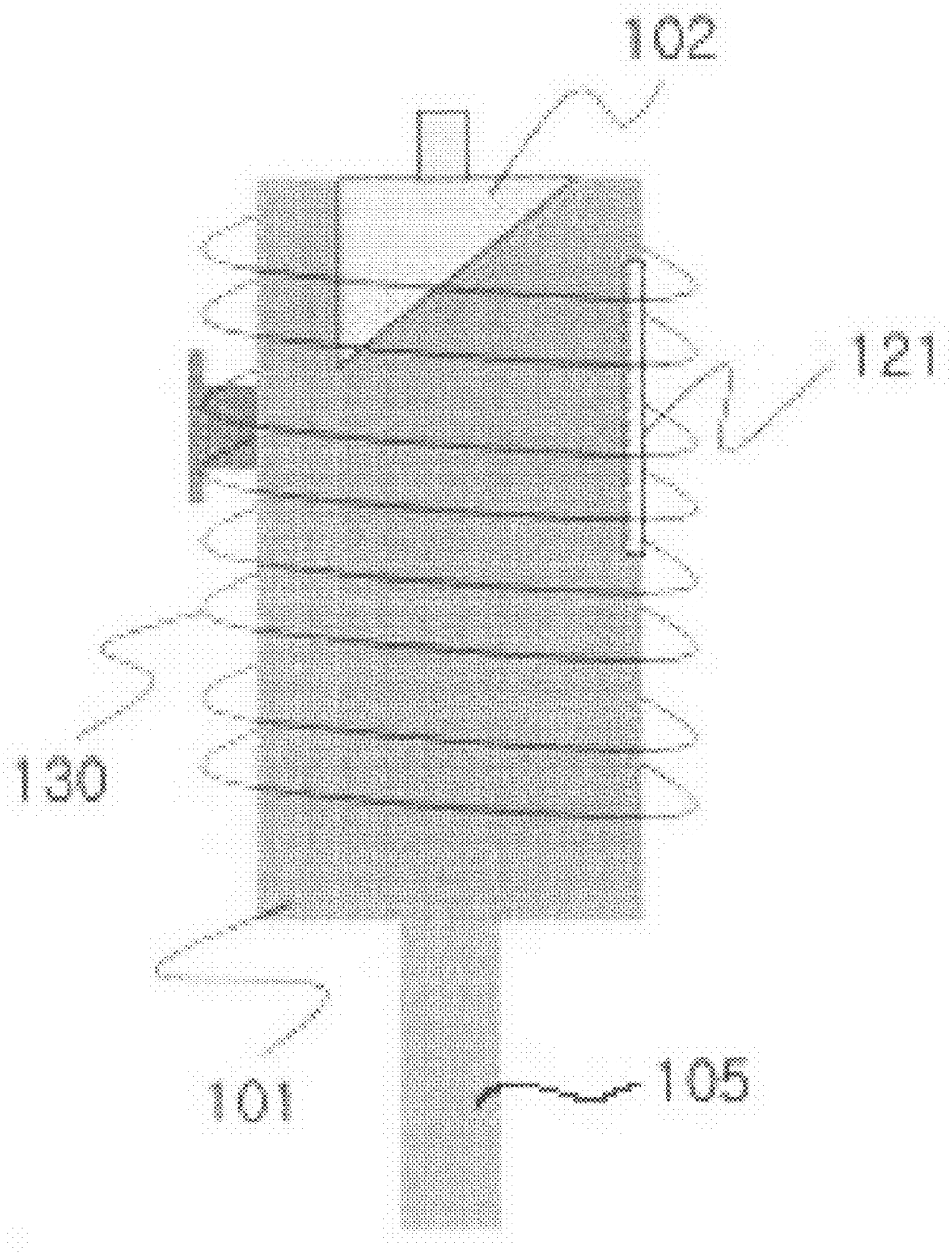
FIG. 6 is a diagram showing a hot wire installed in a circumferential surface of the housing in order to enhance a vacuum degree in the X-ray tube system with a disassembled carbon nanotube substrate for generating micro focusing level electron beams according to the present invention.

Meanwhile, in the X-ray tube system with a disassembled carbon nanotube substrate for generating micro focusing level electron beams according to the present invention as configured thus, a hot wire 130 is preferably additionally installed in a circumferential surface of the housing 101 as shown in FIG. 6, wherein the hot wire serves to enhance a vacuum degree of the housing 101 (an X-ray tube) by electrically heating the housing to outgas from materials constituting the housing and an inner wall of the housing 101, if necessary. And, an insulating material is additionally installed in a circumference of the housing 101 provided with the hot wire 130, wherein the insulating material serves to prevent external exposure of the hot wire 130 and prevent loss of heat generated from the hot wire 130 to the outside.

As described above, the X-ray tube system with a disassembled carbon nanotube substrate for generating micro focusing level electron beams according to the present invention has advantages and effects, as follows.

First, the X-ray tube system of the present invention is composed of a cathode, a grid electrode and an anode which have a basic triode structure and may be easily manufactured, and it is possible to focus a micro level of electron beams in the anode using a modified electron beam focusing lens.

Second, an area where electrons are focused may be significantly reduced by manufacturing an electron focusing lens with a tapered-type shape.

Third, it is possible to easily disassemble the carbon nanotube substrate while sustaining a vacuum state in the X-ray tube since a substrate having a carbon nanotube grown therein is mounted into a sample holder having a shape of a probe.

Accordingly, it is considered that the X-ray tube system of the present invention having the above advantages and effects may predominate over the conventional X-ray tube systems in market competition.

The description proposed herein is just a preferable example for the purpose of illustrations only, not intended to limit the scope of the invention, so it should be understood that other equivalents and modifications could be made thereto without departing from the spirit and scope of the invention as apparent to those skilled in the art. Therefore, it should be understood that the present invention might be not defined within the scope of which is described in detailed description but within the scope of which is defined in the claims and their equivalents.

What is claimed is:

1. An X-ray tube system with a disassembled carbon nanotube substrate for generating micro focusing level electron beams which has an X-ray tube in which electrons emitted from a cathode collide against an anode, the X-ray tube system comprising:

a housing for providing a vacuum space so that the electrons emitted from the cathode collide against an anode;

an anode installed in one side inside the housing and forming an electric field by means of a voltage applied from the outside and accelerating the electrons emitted from the cathode to reach the anode itself;

a carbon nanotube substrate installed inside the housing as a cathode corresponding to the anode and spaced apart at a certain distance from the anode, and having a surface in which a carbon nanotube that emits electrons by application of voltage grows;

a cathode plate for supporting and fixing the carbon nanotube substrate and applying a voltage to the carbon nanotube substrate;

a sample probe installed assemblably/disassemblably in the housing and coupled to the carbon nanotube substrate to form one integrated set so that only a carbon nanotube substrate is exchanged when the carbon nanotube substrate is broken down;

a grid electrode installed in front of the carbon nanotube substrate and extracting electrons from the carbon nanotube substrate in an easy manner;

an electron focusing lens installed in front of the grid electrode and focusing the electrons passed through the grid electrode to form a micro level focus in the anode;

a feed through installed in a plural number around the sample probe and applying a voltage to the cathode, the grid electrode and the electron focusing lens;

a vacuum pump installed assemblably/disassemblably in one side of the housing and sustaining a vacuum state inside the housing in exchanging the carbon nanotube substrate; and a vacuum valve for isolating the inside from the outside of the housing when the sample probe is inserted into the housing and disassembled from the housing.

2. The X-ray tube system according to claim 1, wherein the electron focusing lens is formed in the shape of a tapered-type tube (a frusto-conical cone).

3. The X-ray tube system according to claim 1, wherein a hot wire is additionally installed in a circumferential surface of the housing, the hot wire serving to enhance a vacuum degree of the housing (an X-ray tube) by electrically heating the housing to outgas from materials constituting the housing and an inner wall of the housing, if necessary.

4. The X-ray tube system according to claim 3, wherein an insulating material is additionally installed in a circumference of the housing provided with the hot wire, the insulating material serving to prevent external exposure of the hot wire and prevent loss of heat generated from the hot wire to the outside.

* * * * *